US005853172A

United States Patent [19]

Yetken

[11] Patent Number: 5,853,172

[45] Date of Patent: Dec. 29, 1998

[54] SOCCER BOARD GAME APPARATUS AND METHOD

[76] Inventor: Cengiz Yetken, 706 N. Lombard Ave., Oak Park, Ill. 60302

[21] Appl. No.: 955,689

[22] Filed: Oct. 22, 1997

Related U.S. Application Data

[63] Continuation of Ser. No. 491,471, Jun. 16, 1995, abandoned.

[51] Int. Cl.[6] ..... A63F 7/06

[52] U.S. Cl. ..... 273/108.5; 273/108.1; 273/126 R

[58] Field of Search ..... 273/126 R, 126 A, 273/108.1, 108.5, 127 R, 127 B

[56] References Cited

U.S. PATENT DOCUMENTS

| | | | |
|---|---|---|---|
| 3,741,541 | 6/1973 | Crismani | 273/127 B X |
| 4,018,443 | 4/1977 | Bird | 273/127 B X |
| 5,242,164 | 9/1993 | Nicoll | 273/126 R X |
| 5,431,397 | 7/1995 | Eckel et al. | 273/108.1 |

FOREIGN PATENT DOCUMENTS

| | | | |
|---|---|---|---|
| 1421034 | 11/1965 | France | 273/85 R |
| 2057672 | 6/1972 | Germany | 273/85 R |
| 448848 | 4/1968 | Switzerland | 273/85 R |

*Primary Examiner*—Raleigh W. Chiu
*Attorney, Agent, or Firm*—Niro, Scavone, Haller & Niro

[57] ABSTRACT

A soccer type game to be played on a board with opposing goal areas, where each player, using a stick, attempts to propel a game disk into one of the opposing goals, either directly through strategically placed player posts or by ricochet of the disk off the sides of the boards and/or off the player posts. The player posts are arranged on the board in a unique curvilinear alignment which limits the available scoring paths for the disk, thereby providing a challenging impediment to the scoring of goals.

2 Claims, 4 Drawing Sheets

SOCCER BOARD GAME APPARATUS AND METHOD

This application is a continuation of application Ser. No. 08/491,471 filed Jun. 16, 1995 which application is now: abandoned.

BACKGROUND OF THE INVENTION

The invention relates to an apparatus and method for playing a game and more particularly to a new and improved board game incorporating many aspects of soccer.

There are various board games intended to simulate the game of soccer. U.S. Pat. No. 5,092,595 to Daravina describes a board game that utilizes push sticks, magnetic members selectively placed under the board, and post members selectively placed in a plurality of bores on the top of the board.

U.S. Pat. No. 4,060,245 to Gamez Duch describes a board game with a shooter disk, movable player chips and a ball piece.

In light of these and other references, it can be seen that there is a continued need for a game that utilizes a more strategic placement of defensive player posts to impede the scoring of goals, and that utilizes a set of rules to more closely simulate the game of soccer.

SUMMARY OF THE INVENTION

The present invention provides an apparatus for the simulation of soccer, wherein the game utilizes a game board with vertical sidewalls and strategically placed defensive player posts aligned in a curvilinear arrangement to provide enhanced impediments to the scoring of goals. This curvilinear arrangement is well suited to impede both direct and ricocheted paths of the soccer disk.

The preferred embodiment contemplates the use of disk shaped representation of a soccer ball, as opposed a sphere.

The present invention also provides a method of play that more closely simulates the game of soccer by providing for a type of "goal kick," a type of "corner kick," and a type of "throw in."

DETAILED DESCRIPTION OF THE PREFERRED EMBODIMENT

The game is played by two opposing teams, generally recommended as two individuals players. Teams may be formed by two or more persons per team. In multiple person team play, the individuals should take turns—one kick per person—then the play changes to the opposing team.

Figure 1:
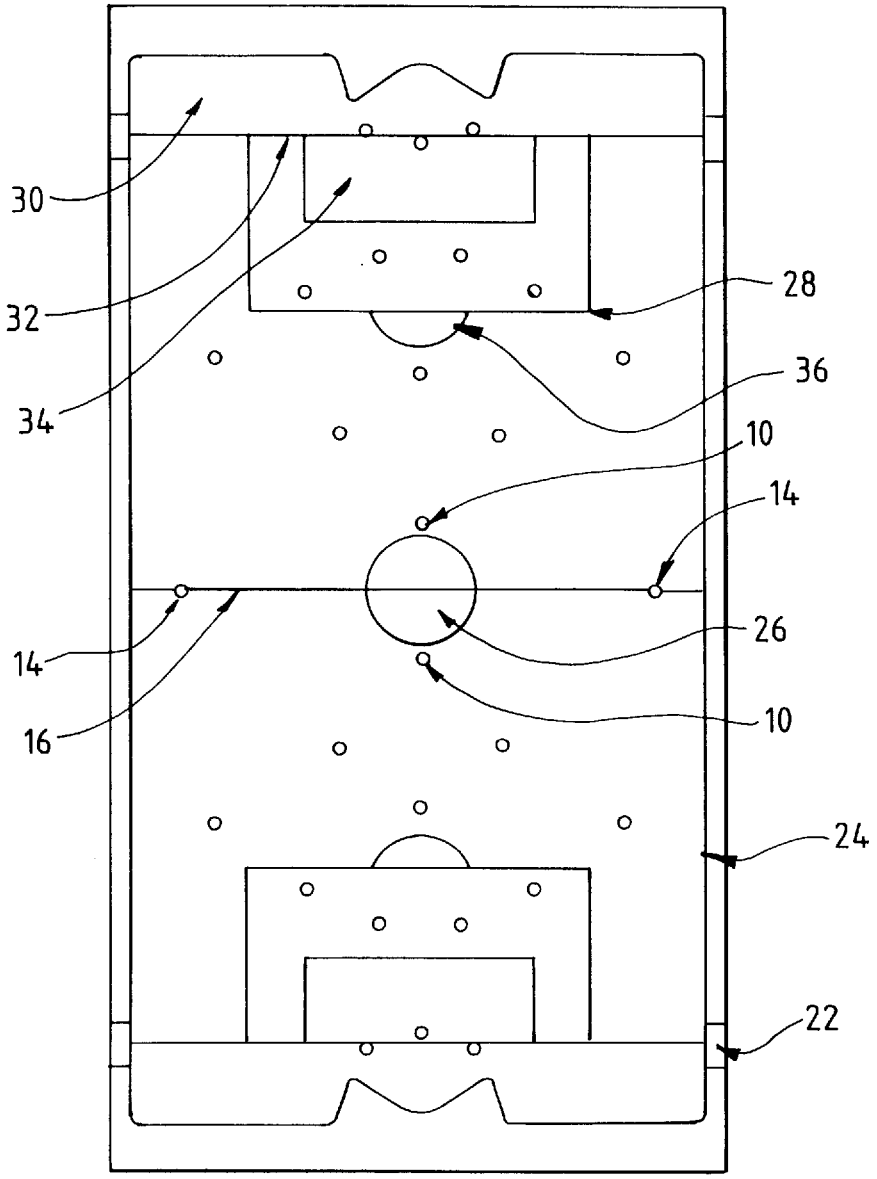
FIG. 1 is a plan view of a board simulating a soccer field.

As shown in FIG. 1, there are a number of player posts at various locations on the board, such as player posts 10 at the opposite ends of the center circle 12 in the center of the playing field, and players 14 on the left and right sides of the center line 16.

To make the play challenging, the remaining player posts are aligned in a curvilinear arrangement to impede the offensive player from making both direct line-of-sight shots directly into the goal, and indirect ricochet shots from the sidewalls of the game board.

Figure 2:
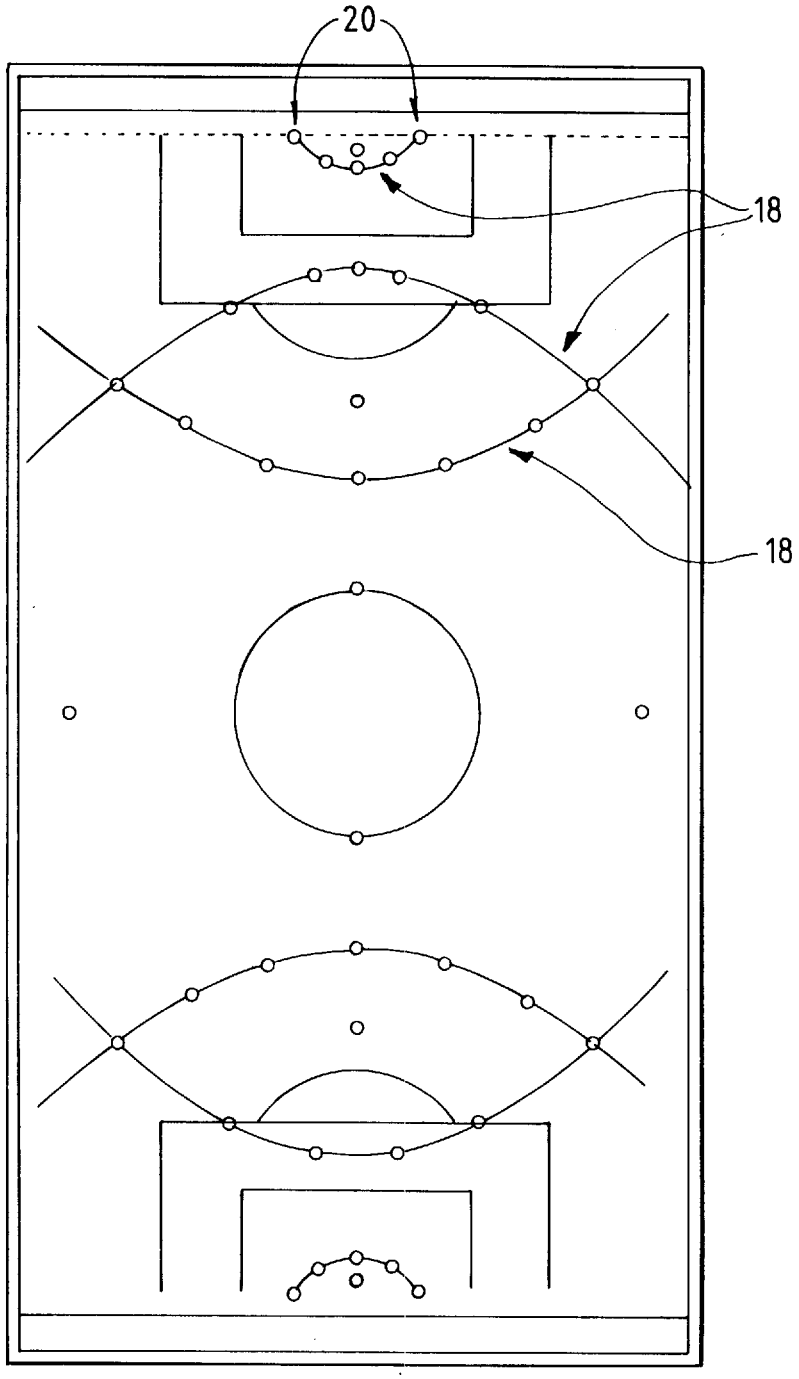
FIGS. 2 and 3 are plan views representing the curvilinear arrangement of defensive player posts.

FIG. 2 shows the curvilinear arrangement of player posts obtained by placing the player posts along curved lines 18. These lines can be defined by any conic section, particularly by a parabola, hyperbola, ellipse or circle. The arrangement may also be defined by other curves such as a catenary arch.

The curvilinear alignment introduces a level unpredictability and challenge into the game. It also allows the development of a player to better his or her game, and develop skills for scoring. Although the defensive player posts are static, their locations make it necessary to make more thoughtful passes. The player develops skill in shooting from creative angles in order to score.

It is also preferred that there be more player posts around the ends of the field than in the central area. This allows freedom of movement at the central area to establish play strategy. When play is closer to the goal posts and scoring positions, scoring angles become narrower, and skill becomes essential for scoring and allows a better chance for the goalie to save the incoming shot.

Preferably, defensive player posts are arranged in such a way that no direct shots are potentially scoreable from central positions. These features make this game simulation closer to the real game of soccer.

With respect to FIG. 1, the areas indicated are the corner kick zone 22, the vertical walls or touchline 24, the center circle 26, the linesman 14, the goal kick area 28, the out of bounds area 30, the goal line 32, the goal area 34, the penalty kick circle 36.

Figure 3:
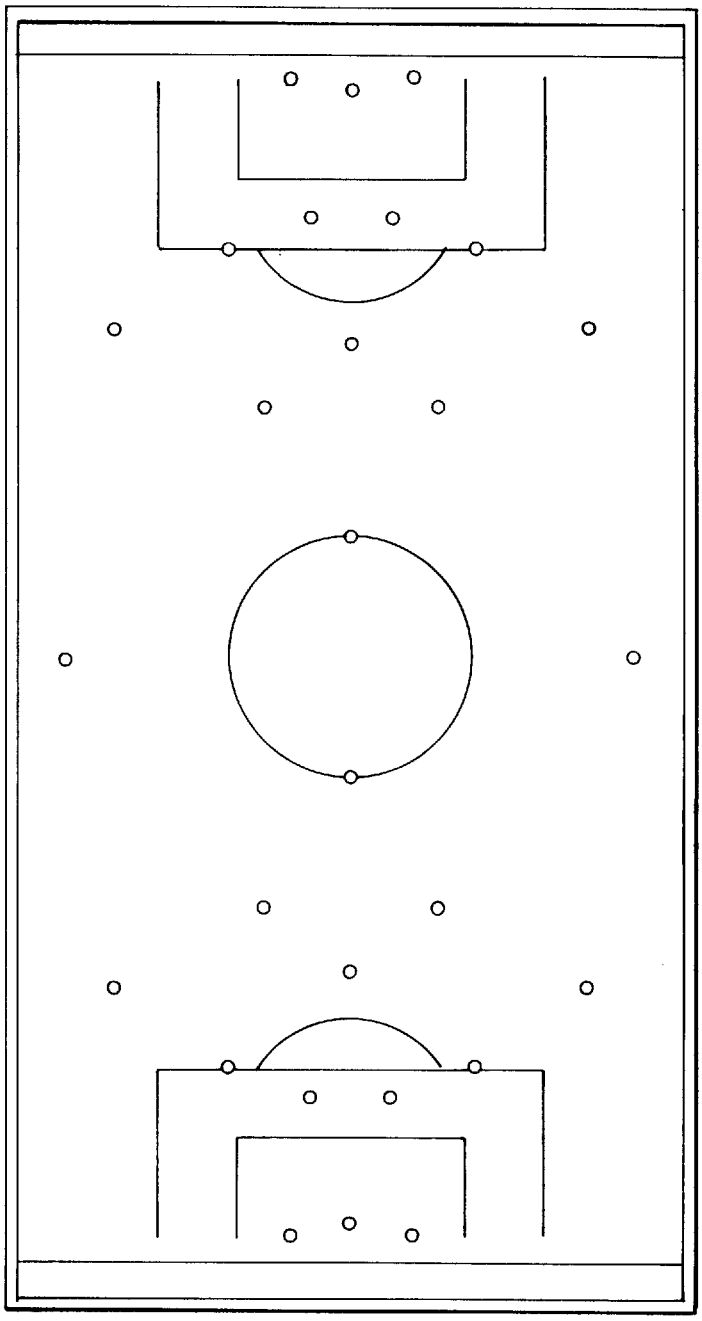

FIG. 3 is a plan view of the preferred embodiment without reference numerals or lines.

Figure 4:
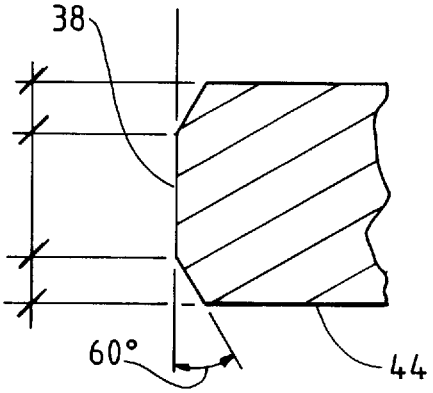
FIGS. 4 and 5 are cross sectional views of the game disk.
Figure 5:
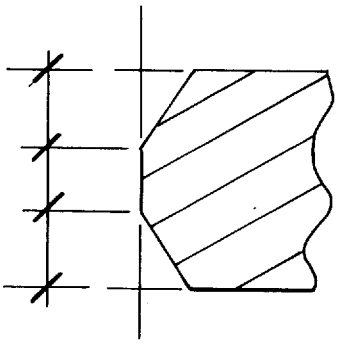

As shown in FIG. 4, the game disk is preferably a flat section of a cylinder, tapered around the top and bottom surfaces of the disk to provide an optimal strike surface 38. Without tapered edges, the rebounding of the disk is too large, resulting in insufficient rebounding for the player to make use of ricochet shots. Too much taper, as shown in FIG. 5, results in a narrow strike surface around the disk edge, resulting in the tendency of the disk to leave the surface upon rebounding, or to rebound in an unstable or unpredictable manner. Thus, the preferred taper of FIG. 4 allows a sufficiently reduced strike surface to increase the rebounding properties, but does not reduce it to the point of instability.

The preferred amount of taper is such that the tapered surfaces form approximately 60 degree angles with the horizontal top and bottom faces of the disk, and of such depth as to leave a strike surface 38 around the edge of the disk of approximately one half to three fourths of the thickness of the disk.

The disk is preferably made of stainless steel of sufficient hardness to ensure good rebounding properties. The disk surfaces should be sanded or polished to ensure good surface friction for sliding the disk along the board once it is propelled. The disk must also be of sufficient weight to ensure good rebounding and sliding properties. Alternatively, the game piece can be a sphere, or a sphere enclosed by a section of a cylinder.

Figure 6:
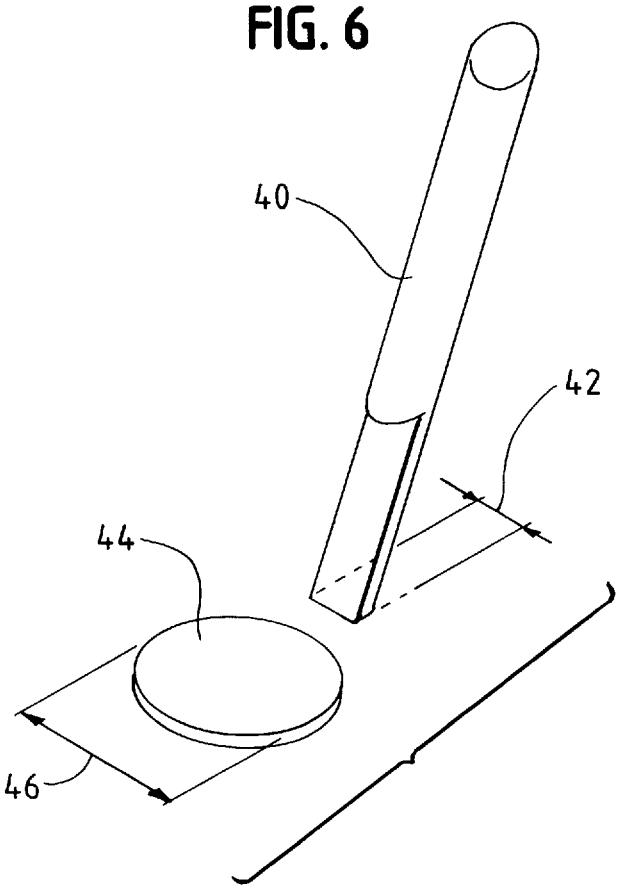
FIG. 6 is perspective drawing of the preferred embodiment of the kick stick.

The disk can be propelled, or "kicked," preferably by means of a stick member, or alternatively by a player's finger or fingernail. The stick member, or kick stick 40, shown in FIG. 6, is preferably slightly flexible at the end so that a player may gently bend the stick against the playing surface behind the game disk, and then allow the stick to straighten in a rapid manner so as to "flick" the game disk, thereby propelling it in the desired direction. Alternatively, the kick stick may be fastened to a player's finger with a simple band or strap, acting as an extension of the player's finger. In this manner, the player may achieve added control over the motion of the stick, and the resulting motion of the game disk.

The width 42 of the kick stick should be wide enough to provide good control over the kicking action, but not so narrow as to cause excessive friction with the game board or prevent access to corner regions of the game board.

The diameter 46 of the game disk 44 can be significantly larger that the player post diameter, or the diameter of the disk can range in size down to approximately equal to the player posts. Alternatively, the player post diameter may be varied to achieve a similar effect. At a minimum, the player posts should be of sufficient diameter to provide a rigid rebounding surface for the game disk. To easily achieve varied ratios of diameters, each game board can be equipped with a plurality of game pieces of different diameters. Smaller game disks would result in larger clearance for shots to be made, while larger disks would require more skill.

By varying the ratio of the diameters of the player posts to the game disk, and the ratio of the game disk diameter to the distance between the posts, the clearance between player posts as well as the dynamics of ricochet shots can be altered. Thus, the arrangement of the player posts in combination with the ratios of the disk diameter to both the distance between adjacent posts, and the diameter of the posts is what makes the game particularly challenging.

Each player has a predetermined number of kicks of the game disk. The number can vary, typically between one and three, depending upon the skill level of the players. If the skill level of the two players differs, one player may receive more kicks per turn than the other player in order to compensate for the differential in skill levels.

As will be herein further described, there are a number of options for the rules of the game, and there are also provisions herein for corner kicks, penalty and goal kicks, free kicks and side throw-ins.

GAME RULE OPTIONS

There are several variations of rules to determine a playing session. In all cases the players must decide the game option before starting the game.

Game Rule Option 1: "Simple" Game, wherein 5 goals constitutes a game. Whichever team scores 5 goals first wins the game. A match consists of 7 games. Whichever team wins the best of 7 games (4 games), wins the match.

Variations of Option 1: Players may decide to increase or decrease the number of goals that constitute a game and number of games that constitute a match. This option is good for learning basic playing skill and for younger players.

Game Rule Option 2: "No Clock" Game.

The game consists of two halves. Each half is played until a total of five (5) goals are made, no matter which team makes them. At the end of the first half, teams change playing fields either by switching seats or by turning the game board around. The team with the most goals out of the 10 possible wins the game. A match consists of an agreed upon number of games i.e. best of 7 or 9 games.

Game Rule Option 3: "Timed" Game.

The game is divided into two halves of 10 minutes each. At the end of the first half, teams change playing fields by either switching seats or turning the game board around. The game is won by the team with the most goals at the end of the 20 minutes.

THE PLAY

The players must decide which team plays first by a method such as a coin toss. The game starts by placing the soccerdisk inside the Center Circle. The game disk (or Soccerdisk) must be positioned totally within the circle, not overlapping the perimeter. The team that initiates kicking in the first half, must let the opposing team start the kick at the beginning of the second half. Each team may get one or more kicks per turn. The only exception is certain penalty kicks. Once the player touches the soccerdisk, even if it is a slight move, that turn is completed. Players may use the kick sticks provided with game, other semi-flexible kicking tools or their fingers. The Soccerdisk must be static before a player may kick it. The Soccerdisk may be ricocheted from the side walls.

Out of Bounds: If a kick by one team causes the soccerdisk to go over the Touch Line to the out-of-play area, then the opposing team gets a "throw-in". The player shall place the soccerdisk on the side edge and flip it towards the opposite team's goal area. Teams can score goals with such a throw. If the soccerdisk crosses over the Goal Line from a kick by the offensive team, the defensive team gets a "goal kick". The defensive team starts the play by placing the game disk in the goal kick area. The goal kick initiates a regular turn of play with the agreed upon number of kicks.

If the soccerdisk crosses over the Goal Line from a kick by the defensive team, the offensive team is awarded a "corner kick". Corner kicks are two strikes. In this case the offensive team places the soccerdisk over the exact corner of the side walls and flips it into the field of play towards the other team's goal. A follow-up kick is executed from the resting position of the soccerdisk after the first kick. A skillful player can score a goal by these two kicks. As in all other cases, the soccerdisk must cross the opposite goal line and under the goal posts in order to score.

To Score a Goal: The soccerdisk must pass between the Goal Posts 20 and completely over the Goal Line toward the OUT OF PLAY area in order to be counted as a goal. The team with the most goals wins the game.

Foul: A foul occurs if the disk hits any part of the body or clothing of the opposing team outside the playing surface. One penalty kick is awarded and taken from the penalty circle.

Breaking Ties: If the game ends in a tie, each team is entitled five (5) free kicks. The free kick starts from the half-circle outside the Goal Zone. The team with the most goals at the end of the five attempts, wins the game. If the game is still tied at the end of these five free kicks, the kicking position moves to the Center Circle and a new set of five (5) free kicks are initiated. Each free kick is allowed two strikes. The soccerdisk should be placed inside the Center Circle, not overlapping the perimeter, as in the Start of Play. The team is then allowed two strikes—an initial kick, then a follow-up kick from the position where the first kick stopped. As in all other cases, the soccerdisk must cross the opposite goal line and under the goal posts in order to score. In multiple-person team play, the team may select the player to perform the kick.

Restarting Game After a Goal is Scored: Once the goal is scored, the team who has been scored against must start from the Center Circle and initiate the first kick.

What is claimed is:

1. A method of playing a game comprising the steps of providing a planar game board having vertical sidewalls defining a playing area therein, a pair of opposing end lines and corresponding goal areas, corner kick zones positioned outside of said playing area and corresponding to each corner formed by said vertical sidewalls, and stationary defensive posts;

providing a game disk;

placing said game disk in one of said corner kick zones; and propelling said game disk into said playing area.

2. A method according to claim 1, wherein each said corner kick zone comprises an area on one of said vertical sidewalls.

* * * * *